US005431781A

United States Patent [19]

Walsh

[11] Patent Number: 5,431,781

[45] Date of Patent: Jul. 11, 1995

[54] PROCESS FOR THE DELIGNIFICATION OF A CHEMICAL PAPER PULP WITH ORGANIC PEROXY ACID

[75] Inventor: Patricia B. Walsh, Kingwood, Tex.

[73] Assignee: Interox America, Houston, Tex.

[21] Appl. No.: 264,196

[22] Filed: Jun. 22, 1994

Related U.S. Application Data

[63] Continuation of Ser. No. 908,083, Jul. 6, 1992, abandoned.

[51] Int. Cl.[6] ..... D21C 9/16; D21C 3/20

[52] U.S. Cl. ..... 162/76; 162/78

[58] Field of Search ..... 162/19, 72, 76, 78; 8/111, 107

[56] References Cited

U.S. PATENT DOCUMENTS 4,400,237 8/1983 Kruger et al. ..... 162/76
4,793,898 12/1988 Laamanen et al. ..... 162/76
4,826,568 5/1989 Gratzl ..... 162/76

FOREIGN PATENT DOCUMENTS 57-21591 2/1982 Japan .

OTHER PUBLICATIONS

C. W. Bailey, "Peroxyacetic Acid Bleaching of Chem Pulps", Tappi, Jan. 1966, vol. 49, #1, pp. 9–15.

*Primary Examiner*—W. Gary Jones
*Assistant Examiner*—Dean T. Nguyen
*Attorney, Agent, or Firm*—Oblon, Spivak, McClelland, Maier & Neustadt

[57] ABSTRACT

Process for the delignification of a chemical paper pulp by means of an organic peroxy acid, according to which the raw pulp arising from the cooking operation is treated with an aqueous solution of this organic peroxy acid, whose hydrogen peroxide content does not exceed 20% of the weight of the peroxy acid.

10 Claims, No Drawings

PROCESS FOR THE DELIGNIFICATION OF A CHEMICAL PAPER PULP WITH ORGANIC PEROXY ACID

This application is a continuation of application Ser. No. 07/098,083, filed on Jul. 6, 1992, now abandoned.

The invention relates to a process for delignifying a chemical paper pulp.

The application of a sequence of delignifying and bleaching treatment stages involving the use of oxidising chemical products to unbleached chemical paper pulps obtained by cooking cellulose materials in the presence of chemical reactants is known. The first stage of a conventional chemical pulp-bleaching sequence has the objective of completing the delignification of the unbleached pulp such as it exists after the cooking operation. This first delignifying stage is traditionally carried out by treating the unbleached pulp with chlorine in acidic medium or with a chlorine-chlorine dioxide combination, as a mixture or in sequence, so as to cause a reaction with the residual lignin in the pulp and to form chlorinated lignins which can be extracted from the pulp by solubilisation of these chlorinated lignins in alkaline medium in a subsequent treatment stage.

For various reasons, it proves to be useful, in certain situations, to be able to replace this first delignifying stage with a treatment which no longer requires a chlorine-based reactant.

It has already been proposed to treat a kraft pulp with oxygen in a first stage followed by a stage with peracetic acid at 70° C. in the presence of diethylenetriaminepentaacetic acid (DTPA) (Patent Application JP-55/94811 in the name of MITSUBISHI GAS CHEMICAL). In this known process, the presence of the stabiliser DTPA prevents a significant degradation of the cellulose chains. However, the protecting effect of the stabiliser does not reach the sufficient level required for the production of high quality pulps.

It has also been proposed to treat the chemical pulps with peracetic acid in a first stage at temperatures higher than 50° C. and pHs of between 3 and 9 (C. W. BAILEY and C. W. DENCE, "Peroxy-acetic Acid Bleaching of Chemical Pulps", Tappi, January 1966, Volume 49, No. 1, pages 9 to 15). In this known process, it appears, however, that the treatment with peracetic acid gives rise to pulps with viscosities and mechanical properties inferior to those of the pulps delignified in a traditional stage by chlorine in acidic medium, as a result of a lower delignification selectivity which is expressed in a more marked attack on the cellulose chains.

The invention aims to remedy the disadvantages of the known processes by providing a process which carries out an efficient delignification of the unbleached chemical pulp which makes it possible to obtain pulps which exhibit high intrinsic qualities over a wide temperature range. Furthermore, it has the additional advantage of avoiding the use of chlorine-based reactants.

To this end, the invention relates to a process for the delignification of a chemical paper pulp by means of an organic peroxy acid, according to which the unbleached pulp arising from the cooking operation is treated with an aqueous solution of this organic peroxy acid, whose hydrogen peroxide content does not exceed 20% of the weight of peroxy acid present in the solution.

According to the invention, chemical paper pulp is meant to denote the pulps which have already undergone a delignifying treatment in the presence of chemical reactants such as sodium sulphide in alkaline medium (kraft or sulphate cooking), sulphur dioxide or a metal salt of sulphurous acid in acid medium (sulphite or bisulphite cooking). According to the invention, chemical paper pulp is also meant to denote the pulps which are called in the literature "semichemical pulps", such as those where the cooking was carried out with the aid of a salt of sulphurous acid in neutral medium (neutral sulphite cooking, also called NSSC cooking), as well as the pulps obtained by processes using solvents, such as the Organosolv, ALCELL®, ORGANOCELL® and ASAM pulps described in Ullmann's Encyclopedia of Industrial Chemistry, 5th Edition, Volume A18, 1991, pages 568 and 569.

The invention is particularly directed at pulps which have undergone a kraft cooking. All the types of wood used for the production of chemical pulps are suitable for use in the process of the invention and, in particular, those used for kraft pulps, namely the coniferous woods such as, for example, the various species of pines and firs and the deciduous woods such as, for example, beech, oak, eucalyptus and hornbeam.

According to the invention, the organic peroxy acid is selected from performic acid and the aliphatic peroxycarboxylic acids containing a single percarboxylic group and a linear or branched saturated alkyl chain of fewer than 11 carbon atoms. The aliphatic peroxycarboxylic acids with the linear saturated alkyl chain containing fewer than 6 carbon atoms are preferred. Examples of such peroxy acids are peracetic acid, perpropanoic acid, n-perbutanoic acid and n-perpentanoic acid. Peracetic acid is particularly preferred owing to its efficiency and the relative simplicity of its preparation methods.

In a variant of the process according to the invention, the organic peroxy acid is selected from the diperoxycarboxylic acids containing a linear or branched alkyl chain of fewer than 16 carbon atoms and two percarboxylic groups substituted on carbon atoms situated at positions which are alpha-omega to each other. Examples of such peroxy acids are 1,6-diperoxyhexanedioic acid, 1,8-diperoxyoctanedioic acid and 1,10-diperoxydecanedioic acid, and 1,12-diperoxydodecanedioic acid.

In another variant of the process according to the invention, the organic peroxy acid is selected from the aromatic peroxy acids containing at least one percarboxylic group per benzene ring. Preferably, the aromatic peroxy acids will be chosen which contain only a single percarboxylic group per benzene ring. An example of such an acid is peroxybenzoic acid.

Another variant of the process according to the invention consists in choosing an organic peroxy acid substituted by one or more halogen atoms or by any other organic functional substituent. Any other organic functional substituent is meant to denote a functional group such as the carbonyl group (ketone, aldehyde or carboxylic acid), the alcohol group, the groups containing nitrogen such as the nitrile, nitro, amine and amide groups or the groups containing sulphur such as the sulpho and mercapto groups.

The peroxy acid can be used without distinction in the form of an aqueous solution of peroxy acid or else in the form of an ammonium, alkali metal or alkalineearth metal salt of this peroxy acid.

According to the invention, the aqueous solution of organic peroxy acid has a weight content of hydrogen peroxide which does not exceed 20% of the weight of the peroxy acid. Preferably, the weight of hydrogen peroxide in the aqueous solution of peroxy acid will not exceed 8% of that of the organic peroxy acid and, in a particularly preferred fashion, will not exceed 6% of this weight.

The aqueous solution of organic peroxy acid which contains only a small quantity of hydrogen peroxide in accordance with the invention can be prepared according to any suitable technique which is directed at obtaining an aqueous solution of organic peroxy acid, whose hydrogen peroxide content does not exceed 20% by weight of the peroxy acid.

According to a variant of the invention, which is preferred, the aqueous solution of peroxy acid is prepared by purification of an aqueous solution of this peracid which contains hydrogen peroxide in a proportion which is more than 20% by weight of the peroxy acid, such as the solutions obtained by reaction to chemical equilibrium between an aqueous solution of hydrogen peroxide and an aqueous solution of the organic acid which corresponds to the peroxy acid in the presence of a small quantity of a catalyst, for example a strong inorganic acid. A particularly preferred variant consists in performing the purification of the peroxy acid solution by distillation. If the purified solution of peroxy acid obtained is not stored at low temperature, it is recommended that it be used without delay according to the process in accordance with the invention; otherwise, the reappearance therein of substantial quantities of hydrogen peroxide may be observed, due to the return towards chemical equilibrium of the compounds present in the solution.

The treatment according to the invention can be carried out in any type of equipment suitable for the treatment of paper pulp by means of neutral or acidic reactants. The retention vat for the unbleached pulp, which is present in all bleaching plants and which acts as buffer reservoir between the cooking unit for the wood and the bleaching unit for the pulp, is particularly highly suitable for carrying out the process according to the invention. The pulp can thus be treated therein during its storage without requiring investment in an expensive dedicated apparatus. Alternatively, the pulp can be stored in a pile for the appropriate retention time: a procedure known as steep bleaching. This method has the advantage that it does not require a large retention vat for longer residence times.

The treatment with organic peroxy acid is generally carried out at a temperature of at least 25° C., and, preferably, of at least 50° C. Likewise, this temperature does not generally exceed 98° C. and, preferably, does not exceed 95° C. The treatment is most often carried out with the organic peroxy acid at atmospheric pressure. The duration of this treatment depends on the temperature and the species of wood which was used in preparing the pulp, as well as the efficiency of the preceding cooking. Generally, duration of at least 15 minutes are convenient. Durations of at least approximately 45 minutes are highly suitable. In many cases, the duration of this treatment does not exceed 360 minutes, but for example in steep bleaching, durations of up to 5 days may also be convenient.

The consistency in the stage of treatment by the organic peroxy acid will generally be chosen to be equal to or greater than 1% solids and, most often, at least 10%. Likewise, the consistency in the stage of treatment by the organic peroxy acid will not generally exceed 40%.

In the process according to the invention, the quantity of organic peroxy acid used is chosen as a function of the degree of residual lignin in the pulp as well as of the average treatment time. Generally, quantities of at least 0.5% and, preferably, of at least 1% by weight of peroxy acid in relation to the dry pulp are highly suitable. Most often, a quantity of peroxy acid will be used which does not exceed 10% and, preferably, does not exceed 5% by weight in relation to the dry pulp.

It can be advantageous, as a variant, to precede the treatment with the organic peroxy acid by a decontaminating pretreatment stage by means of an aqueous acidic solution. This stage has the aim of extracting from the pulp the impurities present in the form of metal ions which are harmful to the satisfactory progress of the bleaching and/or delignification operations. All inorganic or organic acids used in aqueous solution, alone or as mixtures, are suitable. The strong inorganic acids such as, for example, sulphuric acid or hydrochloric acid are highly suitable. Sulphuric acid is particularly preferred.

It is advantageous that the acidic decontaminating pretreatment be additionally carried out in the presence of a complexing agent for metal ions. To this end, mixtures of the strong inorganic acids mentioned above with organic acids from the class of aminopolycarboxylic or aminopolyphosphonic acids or their alkali metal salts are particularly highly suitable. Examples of suitable aminopolycarboxylic acids are diethylenetriaminepentaacetic acid, ethylenediaminetetraacetic acid; cyclohexanediaminetetraacetic acid and nitrilotriacetic acid. Diethylenetriaminepentaacetic acid (DTPA) is preferred. Examples of aminopolyphosphonic acids are diethylenetriaminepenta(methylenephosphonic) acid (DTMPA), ethylenediaminetetra(methylenephosphonic) acid, cyclohexanediaminetetra(methylenephosphonic) acid (CDTMPA) and nitrilotri(methylenephosphonic) acid. DTMPA is preferred. The quantities of complexing agent to be used depend on the efficiency of the complexing agent selected and on the metal content of the pulp to be treated. In practice, at least 0.01% by weight of complexing agent in relation to the dry pulp and, most often, at least 0.05% is generally used. Likewise, the weight of complexing agent in relation to the dry pulp does not generally exceed 1% and, most often, does not exceed 0.25%.

The operating conditions of the acidic decontaminating pretreatment are not critical. They must be determined in each particular case as a function of the type of paper pulp and the equipment in which the treatment is carried out. In general, it is suitable to set the choice of acid and the quantity used in order to impose a pH of less than 7 on the medium, for example, from at least approximately 1 to at most approximately 6.5. Especially advantageous pHs are those from at least approximately 2.0 to at most approximately 5.0. The temperature and the pressure are not critical, room temperature and atmospheric pressure generally being highly suitable. The duration of the pretreatment can vary within wide proportions according to the type of equipment used, the choice of acid, the temperature and the pressure, and is, for example, from approximately 15 minutes to several hours.

It is also possible to replace the decontaminating pretreatment by the incorporation of one or more complexing agents for metal ions into the delignification stage with peroxy acid itself. These are chosen from the same complexing agents as those described above for the decontaminating pretreatment stage. A further possibility is the combination of the decontaminating pretreatment with the incorporation of one or more complexing agents into the delignification stage.

In another variant of the process according to the invention, it is possible, if it is wished to obtain high levels of brightness, to follow the treatment with a peroxy acid by a sequence of additional bleaching stages, optionally involving chlorine-based reactants. Examples of such stages are the following: stages with gaseous oxygen or ozone, stages with alkaline hydrogen peroxide, optionally in the presence of gaseous oxygen, stages with chlorine dioxide or with sodium hypochlorite, or alkaline extractions with sodium hydroxide solution.

The examples which follow are given with the aim of illustrating the invention, but without limiting its scope.

In the examples, measurements were made according to the following standards:

brightness: Tappi Methods T 218, 0M83 and T 525, 0M86;

kappa: Tappi Method T 236, CM85;

viscosity : Tappi Method T 230, 0M89.

EXAMPLES 1R to 3R: (not in accordance with the invention)

The effect of a delignification with peracetic acid was studied on a deciduous, kraft pulp (initial brightness 28.7° ISO, kappa value 16.7 and viscosity 27.4 mPs) by means of a two-stage sequence: peracetic acid—extraction with sodium hydroxide solution. The stage of extraction with sodium hydroxide solution was carried out under conditions of constant temperature (77° C.), duration (45 minutes) and consistency (10% by weight of solids). The stage with peracetic acid was carried out under various temperature conditions ranging from 71° C. to 93° C., the other conditions being constant: duration of 180 minutes, quantity of peracetic acid of 3% in weight in relation to the solids and consistency of 10% solids.

The peracetic acid used was an aqueous solution containing 12.4% by weight of peracetic acid, 15.7% of hydrogen peroxide, 29.6% of acetic acid and 0.8% of sulphuric acid.

The results are given in the table which follows:

| Example No. | Temperature Paa stage °C. | pH of stage Paa init. | pH of stage Paa fin. | Final kappa number | Viscosity mPs |
|---|---|---|---|---|---|
| 1R | 71 | 4.1 | 4.0 | 9.4 | 13.0 |
| 2R | 82 | 4.1 | 4.0 | 8.7 | 6.5 |
| 3R | 93 | 4.1 | 4.0 | 8.5 | 2.8 |

EXAMPLES 4 to 6: (in accordance with the invention)

Examples 1R to 3R were reproduced, replacing the aqueous solution of peracetic acid with a solution of distilled peracetic acid containing 27.2% by weight of peracetic acid, 1.97% by weight of hydrogen peroxide, 9.6% by weight of acetic acid and less than 0.1% by weight of sulphuric acid.

The results obtained are given in the table which follows:

| Example No. | Temperature Paa stage °C. | pH of stage Paa init. | pH of stage Paa fin. | Final kappa number | Viscosity mPs |
|---|---|---|---|---|---|
| 4 | 71 | 5.3 | 4.5 | 7.4 | 16.1 |
| 5 | 82 | 5.3 | 4.5 | 7.5 | 13.8 |
| 6 | 93 | 5.3 | 4.6 | 8.0 | 11.8 |

I claim:

1. Process for the delignification of a chemical paper pulp by means of an organic peroxy acid, wherein a raw pulp coming directly from a cooking operation is treated with an aqueous solution of said organic peroxy acid, having a hydrogen peroxide content which does not exceed 20% of the weight of the peroxy acid, wherein the process provides a reduction in kappa number of at least 8.7 and a reduction in viscosity of no more than 15.6, said organic peroxy acid being purified by a distillation operation before being used.

2. Process according to claim 1, in which the hydrogen peroxide content of the organic peroxy acid solution does not exceed 8% of the weight of said organic peroxy acid of said organic peroxy acid solution.

3. Process according to claim 1 or 2, in which the organic peroxy acid is selected from performic acid and the aliphatic peroxycarboxylic acids containing a single percarboxylic group and a linear or branched saturated alkyl chain of fewer than 11 carbon atoms.

4. Process according to claim 1 or 2, in which the organic peroxy acid is selected from the diperoxycarboxylic acids containing a linear or branched alkyl chain of fewer than 16 atoms and two percarboxylic groups substituted on carbon atoms situated at positions which are alpha-omega to each other.

5. Process according to claim 1 or 2, in which the organic peroxy acid is selected from the aromatic peroxy acids containing one percarboxylic group per benzene ring.

6. Process according to claim 1 or 2, in which the treatment with the organic peroxy acid is preceded by a pulp decontaminating pretreatment stage by means of an aqueous acidic solution.

7. Process according to claim 6, in which the aqueous acidic solution contains at least one complexing agent for metal ions.

8. Process according to claim 1 or 2, in which a complexing agent for metal ions is incorporated into the peroxy acid treatment.

9. Process according to claim 1 or 2, wherein the organic peroxy acid is peracetic acid.

10. Process according to claim 1 or 2, wherein said pulp is a kraft pulp.

* * * * *